United States Patent [19]

Miyosawa et al.

[11] 3,960,676

[45] June 1, 1976

[54] COATING PROCESS FOR ALUMINUM AND ALUMINUM ALLOY

[75] Inventors: Yoshiaki Miyosawa; Sueo Umemoto, both of Hiratsuka, Japan

[73] Assignee: Kansai Paint Company, Ltc., Japan

[22] Filed: Sept. 24, 1973

[21] Appl. No.: 400,171

[30] Foreign Application Priority Data

Oct. 4, 1972 Japan ..... 47-98943

[52] U.S. Cl. ..... 204/38 A; 204/38 E; 204/38 R

[51] Int. Cl.[2] ..... C25D 5/00; C25D 13/06; C25D 9/02

[58] Field of Search ..... 204/58, 38 A, 38 E, 204/40, 42, 181, 38 R; 101/457

[56] References Cited

UNITED STATES PATENTS

| | | | |
|---|---|---|---|
| 2,714,066 | 7/1955 | Jewett et al. | 101/457 |
| 3,281,243 | 10/1966 | Sorkin et al. | 101/457 |
| 3,622,473 | 11/1971 | Ohta et al. | 204/38 A |
| 3,658,662 | 4/1972 | Casson et al. | 204/58 |

FOREIGN PATENTS OR APPLICATIONS

| | | | |
|---|---|---|---|
| 409,940 | 5/1967 | Australia | 204/181 |

*Primary Examiner*—R. L. Andrews

*Attorney, Agent, or Firm*—Ostrolenk, Faber, Gerb & Soffen

[57] ABSTRACT

A coating process for articles made of aluminum or aluminum alloy to form a composite coating which is excellent in adherent and anti-corrosive properties, in which the articles are treated in an aqueous solution of water-soluble oxyacid salts selected from the group consisting of silicates, borates, phosphates, chromates, molybdates, vanadates and permanganates with applying electric current to form a conversion coating layer on the aluminum surface, and are further treated with a water-soluble or water-dispersible coating composition to form a finish coat on the conversion coating layer particularly by dipping or electrodeposition.

8 Claims, No Drawings

COATING PROCESS FOR ALUMINUM AND ALUMINUM ALLOY

This invention relates to a coating process for aluminum or aluminum alloy. More particularly, the invention relates to a novel process of forming a coating having excellent smoothness, anticorrosiveness and workability on the surface of articles made of aluminum or aluminum alloy which will be hereinafter referred to as only "aluminum" in this specification.

The adhesive property of organic coating materials to an aluminum surface is generally poor, so several measures for improving the adhesion have been taken in the prior art. For example, it is well known that the aluminum surface is first subjected to anodic oxidation in an acid bath such as a sulfuric bath, then immediately after that step, the surface of the thus formed porous aluminum oxide layer is treated by dipping or electrodeposition to adsorb the solid component of a water-soluble or water-dispersible coating composition to the porous layer, and thereafter it is heated to form a cured coating film.

However, this method has several disadvantages, for example, the anodic oxidation procedure takes a long time (to the extent of several tens of minutes), the anodic oxidation coating is thick (more than several microns), and the coating film is inferior in workability and shock resistance. The ingredient in the treating solution, such as sulfuric acid, is liable to be retained within the pores of the oxide layer anodically formed, and, furthermore when water-soluble coating material is electrodeposited, it is difficult to obtain a thick coating owing to the high electric resistance of the oxide layer.

The process of the present invention is free from the above-mentioned disadvantages, that is, in the process of the invention, an article made of aluminum or aluminum alloy is treated by applying electric current through the surface in a aqueous solution of one or more water-soluble oxyacid salts selected from the group consisting of silicates, borates, phosphates, chromates, molybdates, vanadates and permanganates, and then further treated with a water-soluble or water-dispersible coating composition.

In the coating process of the present invention, the aluminum article is, as the first step, subjected to an electrochemical treatment in an aqueous solution of water-soluble oxyacid salts to form a conversion coating layer on the surface of aluminum. The conversion coating layer is absolutely nonporous so that it does not retain the component of the bath. Furthermore, the adhesion of the conversion coating layer to the aluminum substrate is firm and the anticorrosiveness thereof is superior so that it serves as the sub-coat for organic coating. Still further, the thickness of the conversion coating layer is so small compared with an anodized oxide layer that the electric resistance thereof scarcely affects the ease of the finish-coat electrodeposition and the thickness of the finish-coat is widely regulated in accordance with applied electric voltage in the electrodeposition coating procedure.

Another advantage of the coating process of the present invention is that an extremely short time, such as not more than 1 minute, is sufficient for the electrochemical treatment in the oxyacid salt bath as compared with the conventional practice which requires a tediously long duration of time for anodic oxidation.

As the oxyacid salts used in the present invention, there are those selected from the group consisting of silicates, borates, phosphates, chromates, molybdates, vanadates and permanganates. Specific examples of the oxyacid salts are as follows.

SILICATES

Silicates as represented by the general formula: $M_2'O.xSiO_2$ in which M' is Li, Na or K, and $x$ is a positive numeral from 1.5 to 4.0, for example, lithium silicate, sodium silicate, potassium silicate and the like.

BORATES

Lithium metaborate ($LiBo_2.2H_2O$), lithium tetraborate ($Li_2B_4O_7.5H_2O$), sodium metaborate ($NaBO_2$), sodium tetraborate ($Na_2B_4O_7.10H_2O$), sodium pentaborate ($Na_2B_{10}O_{16}.10H_2O$), sodium perborate ($NaBO_2.H_2O_2.3H_2O$), hydrogen peroxide adduct of sodium borate ($Na_4B_4O_7.H_2O_2.9H_2O$), sodium boroformate ($NaH_2BO_3.2HCOOH.2H_2O$), potassium metaborate ($KBO_2$), potassium tetraborate ($K_2B_4O_7.5H_2O$), ammonium tetraborate [$(NH_4)_2B_4O_7.4H_2O$], and ammonium biborate [$(NH_4)HB_4O_7.3H_2O$].

PHOSPHATES

Sodium metaphosphates as represented by the general formula: $(NaPO_3)n$ in which n is a positive integer from 1 to 12, for example, sodium hexametaphosphate and the like.

CHROMATES

Lithium chromate ($Li_2CrO_4.2H_2O$), sodium chromate ($Na_2CrO_4.10H_2O$), potassium chromate ($K_2CrO_4$), ammonium chromate [$(NH_4)_2CrO_4$], calcium chromate ($CaCrO_4.2H_2O$), and strontium chromate ($SrCrO_4$).

MOLYBDATES

Molybdates as represented by the general formula: $xM_2O.yMoO_3.nH_2O$ in which M is Li, Na, K or ($NH_4$), $x$ is an integer from 1 to 5, y is an integer from 1 to 12, and $n$ is zero (0) or a positive integer such as 3, 4 or 5, for example, lithium molybdate ($Li_2MoO_4$), sodium molybdate ($Na_2MoO_4$), potassium molybdate ($K_2MoO_4.5H_2O$), ammonium heptamolybdate [$(NH_4)_6Mo_7O_{24}.4H_2O$], sodium phosphomolybdate ($Na_3PO_4.12MoO_3$) and ammonium phosphomolybdate [$(NH_4)_3PO_4.12MoO_3.3H_2O$].

VANADATES

Lithium orthovanadate ($Li_3VO_4$), sodium orthovanadate ($Na_3VO_4$), lithium metavanadate ($LiVO_3.2H_2O$), sodium metavanadate ($NaVO_3.4H_2O$), potassium metavanadate ($KVO_3$), ammonium metavanadate [$NH_4VO_3$ or $(NH_4)_4V_4O_{12}$], and sodium pyrovanadate ($Na_2V_2O_7$).

PERMANGANATES

Sodium permanganate ($NaMnO_4.3H_2O$), potassium permanganate ($KMnO_4$), and ammonium permanganate [$(NH_4)MnO_4$].

These oxyacid salts may be used alone or in a combination of two or more so long as they do not produce a precipitate by the reaction between them.

The concentrations of these water-soluble oxyacid salts in the aqueous solution are 5 to 45, preferably 10 to 30 % by weight in case of silicates, 1 to 2.5, preferably 1.2 to 2.0 % by weight in case of permanganates, and 1 % by weight to saturation, preferably 2 to 10 % by weight in case of other salts. If the concentration in the aqueous solution is less than 1 % by weight (when silicate is used, less than 5 % by weight), it becomes difficult to form a continuous conversion layer, or the treatment takes a very long period of time, so that it is not preferable. Further, when an aqueous solution of more than 45 % by weight of silicate is used, the solution becomes very viscous, and the uniform treatment can not be attained. Furthermore, when an aqueous solution of more than 2.5 % by weight of permanganate is used, a porous coating layer is formed and the continuity of the layer is lost; accordingly the effect of the present invention can not be expected.

In order to form a continuous layer on the surface of aluminum by using the aqueous solution of the water-soluble oxyacid salts, the aluminum article is immersed in the aqueous solution, and electric current is applied to the article as an electrode. The electric current may be either direct current or alternating current, and when direct current is used, the aluminum article is to be the anode. The preferable range for the electric voltage is 5 to 200, preferably 30 to 120 volts for direct current, or 5 to 60, preferably 10 to 40 volts for alternating current. When an electric voltage exceeding 200 volts (direct current) or 60 volts (alternating current) is applied, a thick and uneven film which is inadequate as the sub-coat in view of the bending property is formed, or the formed continuous layer is liable to be damaged, so that it is not preferable.

If the electric voltage is less than 5 volts, the formation of the continuous layer is difficult; therefore, the excellent coating system of the present invention having high anticorrosiveness and workability can not be obtained.

The time for the electric current supply is not restricted provided it exceeds 5 seconds. The formed layer is non-porous and electrically insulative which is different from the porousoxide layer anodically formed in the acid bath as the conventional sub-coat in the normal coating process. Therefore, when constant voltage is applied, the electric current promptly decreases and becomes approximately constant which is near to zero, that is, for example, about 30 seconds after the initial energizing. The current supply may be stopped at this stage. The application sequence of the electric voltage may be selected voluntarily, that is, a comparatively higher voltage is applied from the beginning and held constant, or alternatively, an ascending voltage with a comparatively low starting voltage is applied. Further, the supply of electric current may be started after the entire aluminum article is immersed in the bath solution, or alternatively, application of the electric voltage to the aluminum article can be started prior to immersing into the bath. In other words, the conditions of the treatment can be determined in various ways according to requirements. Further, it is convenient that the temperature of the oxyacid salt solution is within the range of 10° to 40°C which is about room temperature.

In the present invention, the oxyacid salt solution is alkaline or roughly neutral and has a pH value not below 6; therefore even when the aluminum article as the anode is treated with a supply of direct current, the formed conversion coating layer is non-porous, which is different from the known oxide layer anodically formed using a solution of sulfuric acid or oxalic acid. The pH of the solutions of oxyacid salts, except silicates and permanganates, is not more than 10, and even though the solutions of silicate have a higher pH value exceeding 12, a protective layer is formed on the aluminum surface just after the immersion through the non-electrochemical reaction between the aluminum and silicates, so that the surface of aluminum is neither dissolved nor corroded. In case of the permanganate solutions which have an intense oxidizing property, an oxidized layer is formed on the aluminum surface soon after the immersion and the surface becomes passive; therefore, there is no fear of dissolving the aluminum surface.

As explained above, the conversion coating layer on the aluminum surface of the present invention is non-porous and continuous, which is different from those obtained by the conventional anodic oxidation. The above can be presumed from the fact that, for example, a current density of 3 to 10 Amp/dm$^2$ of direct current in the initial stage is reduced to about 0.1 Amp/dm$^2$ after 60 seconds in all of the experiments. Further, the above fact has been confirmed by the morphological observation of the surface through an electron microscope. In case of an alternating current supply, the residual current is somewhat larger, for example, when an electric voltage of 30 volts, 50 hertz is applied, it reaches the stationary state of a current density of 1 to 3 Amp/dm$^2$; however, this is due to electromagnetic induction, and according to morphological observation, the formed coating layer is non-porous in like manner as that in the direct current supply. Further, in order to obtain a positive proof of such fact, a detection test of penetrating pores of conversion coating has been carried out by the well known method using a reagent composed of acetic acid, copper sulfate and zinc chloride, and the result was negative.

In the process of the present invention, the conversion coating on the aluminum surface has a chemical composition different from the coating formed by the conventional anodic oxidation, and is not simple aluminum oxide but insoluble compound which contains, as one component, the specific element such as the metallic element of the anionic portion of the oxyacid salt which is dissolved in the treating solution. This fact can be proved by the X-ray fluorescense spectrometry. That is, as shown in Table 1, one compound of each group of oxyacid salts (except for borate) was selected and an aqueous solution of each was prepared. Then, aluminum plates of high purity were treated in the solutions with the supply of electric current as indicated in the Table 1 at a temperature of 30°C, and they were then rinsed completely with tap water and then with deionized water, and were dried. The treated plates were tested by an X-ray fluorescense spectrometer (made by Rigaku Denki Co., Ltd., Japan; type: KGX) to measure the intensities (relative values) of scattered characteristic X-ray which are shown in Table 1. With regard to boron, the X-ray fluorescense spectrometry can not be applied; however, the existence was confirmed through chemical analysis (colorimetric analysis).

Table 1

| Treating solution Oxyacid salts | Concentration (wt %) | pH | Voltage (V) | Current supply (sec) | X-ray tube and analyzing crystal | Detected X-ray | Intensity of detection (count/sec) |
|---|---|---|---|---|---|---|---|
| Sodium silicate $Na_2O.2SiO_2$ | 10 | 12.4 | DC 40<br>DC 60<br>AC 30 | 60 | Chromium tube, EDDT | SiKα | 35<br>60<br>25 |
| Sodium polymetaphosphate $(NaPO_3)_n$ | 5 | 6.0 | DC 40<br>DC 60<br>AC 30 | 60 | Chromium tube, EDDT | PKα | 40<br>60<br>30 |
| Potassium chromate $K_2CrO_4$ | 2.5 | 8.5 | DC 40<br>DC 60<br>AC 30 | 60 | Tungsten tube, LiF | CrKα | 50<br>100<br>40 |
| Potassium molybdate $K_2MoO_4$ | 5 | 7.2 | DC 40<br>DC 60<br>AC 30 | 60 | Tungsten tube, LiF | MoKα | 80<br>160<br>60 |
| Potassium metavanadate $KVO_3$ | 2 | 6.9 | DC 40<br>DC 60<br>AC 30 | 60 | Tungsten tube, LiF | VKα | 20<br>35<br>20 |
| Potassium permanganate $KMnO_4$ | 2 | 12.1 | DC 40<br>DC 60<br>AC 30 | 60 | Tungsten tube, LiF | MnKα | 50<br>100<br>40 |

Note: In the X-ray fluorescense spectrometry, the X-ray tube was operated at 50 kV, 30 mA.

As the second stage, an aqueous coating composition is applied on the surface of the aluminum article which is pretreated as above and has a conversion coating layer. The conversion coating layer is of hydrophilic nature; accordingly, when applied with a finish coating composition containing a highly polar resin as the vehicle, such as water-soluble or water-dispersible resin compositions, an excellent adhesion which has never been attained in the conventional coating processes is effectuated, so that the finish coating has an extremely high anti-corrosive property. This is one of the principal objects of the present invention.

As the finish coating on the conversion coating, any of the aqueous coating materials well known in the art may be employed, and special material is not needed. For example, the aqueous coating compositions such as those containing epoxy resin, melamine-formaldehyde resin, alkyd resin, polyester, acrylic resin, polybutadiene, natural resin and modified fatty oil can be used in the present invention. The manner of applying these aqueous coating materials is not limited to any special one and any of the well known methods may be employed. However, dip coating or electrodeposition is particularly recommended due to their speed.

When these aqueous coating compositions are applied by means of electrodeposition, somewhat higher voltage must be imparted compared with coating non-treated aluminum plates because, in the present invention, the surface of aluminum is already covered by a thin resistant layer. That is, even when the material which can be electrodeposited with a lower voltage is used, the voltage should be at least 5 volts, preferably 20 volts, higher than that applied in the conversion coating procedure, otherwise a sufficiently thick finish-coat can not be formed. It is not otherwise necessary to vary the operation conditions in the known electrodeposition.

In curing of the finish coating on the conversion coating, any conditions can be employed recommended for the coating material. For example, in heat curing, a temperature of 80° to 300°C and a duration of 0.5 to 60 minutes may be employed, and within these ranges, damage of the conversion coating on the aluminum surface and accompanying deterioration of adhesion and anticorrosiveness of the finish coating are never caused.

In accordance with the process of the present invention as disclosed in the above, a composite coating composed of a conversion coating which is dense and hydrophilic and a finish coating having an excellent adhesive property to the former can be formed on the surface of aluminum. Moreover, the coating process is very simple requiring only a short time, therefore, it can be advantageously practised in various industrial fields in which any aluminum article is treated.

In order that the invention may be more fully understood, preferred examples and various supplementary features will now be described.

EXAMPLE 1 TO 4

Aqueous solutions of potassium chromate having concentrations of 2.0, 5.0 and 10.0% by weight were prepared, and four aluminum plates (grade: 5052P in Japanese Industrial Standard) of 0.8 mm in thickness were immersed in the solutions, two in the 5.0 % solution and the other two in the 2.0 % and 10.0 % solutions, respectively. Each of the aluminum plates were then connected to the anode of a direct electric power source and direct electric voltage of 30, 50 or 60 volts was applied between the aluminum plate and a mild steel plate immersed in the same bath maintained at a temperature of 25°C for 60 seconds.

The electrochemically converted aluminum plates were rinsed with water and dried in air. Then a finish coating was applied onto the thus treated aluminum plates electrophoretically using an aqueous coating composition for clear coat containing a water-soluble acrylic resin (trade name: "Aron 4002" made by Toa Synthetic Chemicals Industry Co., Ltd.) and a water-soluble melamine-formaldehyde resin (trade name: "Nikalac MX-40" made by Nippon Carbide Industries Co., Ltd.) in a ratio of solid components of 74 : 26 by weight. The pH of the coating composition for electrodeposition was adjusted to 8.0 using triethylamine and the content of the non-volatile matter was adjusted to 10.0 % by weight. In the electrodeposition, the aluminum plates were again made the anode and direct current of 100 volts was supplied for 60 seconds at a bath temperature of 25°C. After switching the current off and rinsing with water, the plates were heated at 200°C for 30 minutes in an oven to cure the electrodeposited coating.

As a result, a glossy coating with excellent adhesion to the substrate was formed on the aluminum plates and the plates showed high anti-corrosiveness.

For affirmation, Erichsen film tests, impact tests and salt spray tests were carried out on these coated plates, and the results are shown in the following Table 2.

COMPARATIVE EXAMPLE 1

A resin-coated aluminum test plate was prepared in like manner as the foregoing Examples 1 to 4 except that this test plate was not treated by the aqueous solution of potassium chromate. The coated test plate was also subjected to the similar film tests, the results of which are shown in Table 2.

EXAMPLES 5 TO 21

In place of the potassium chromate solution in the foregoing Examples 1 to 4, aqueous solutions containing potassium molybdate ($K_2MoO_4$), potassium permanganate ($KMnO_4$), ammonium me tavanadate ($NH_4VO_3$), potassium metaborate ($KBO_2$), sodium silicate ($2SiO_2.Na_2O$) or sodium polymetaphosphate [$(NaPO_3)n$] having the concentration listed in Table 2 were used. Aluminum test plates like those in Examples 1 to 4 were treated in the above solutions with direct current or alternating current as indicated in Table 2 for 60 seconds, respectively. Conversion coatings were thereby formed on the aluminum surface. When the alternating current was applied, ultrasonic vibration of 500 kHz frequency was transmitted to the aluminum test plates in order to prevent the occurrence of unevenness of the conversion coatings by bubbling.

Then, the clear finish coating was formed by electrodeposition onto the surface of the test plates in like manner as in the foregoing Examples 1 to 4, and similar film tests were carried out, the results of which are shown in the following Table 2.

Table 2

| Example number | Conversion coating: Oxyacid salt | Conc. (wt%) | Voltage (V) *1 | Thickness of electro-deposition coating (microns) | *2 Erich-sen test | *3 Impact test | *4 Salt spray test |
|---|---|---|---|---|---|---|---|
| 1 | $K_2CrO_4$ | 2.0 | DC 50 | 8 | 100 | 40 | 0 |
| 2 | do. | 5.0 | DC 30 | 8 | 100 | 40 | 0 |
| 3 | do. | 5.0 | DC 60 | 10 | 100 | 40 | 0 |
| 4 | do. | 10.0 | DC 50 | 10 | 100 | 40 | 0 |
| 5 | $K_2MoO_4$ | 2.0 | DC 50 | 8 | 100 | 50 | 0 |
| 6 | do. | 5.0 | DC 50 | 9 | 100 | 50 | 0 |
| 7 | $KMnO_4$ | 2.0 | DC 30 | 18 | 100 | 40 | 0.5 |
| 8 | $NH_4VO_3$ | 2.0 | DC 50 | 10 | 100 | 40 | 0.5 |
| 9 | $KBO_2$ | 2.5 | DC 50 | 10 | 100 | 50 | 0 |
| 10 | do. | 5.0 | DC 50 | 8 | 100 | 50 | 0 |
| 11 | $2SiO_2.Na_2O$ | 10.0 | DC 50 | 12 | 100 | 50 | 0 |
| 12 | do. | 15.0 | DC 50 | 10 | 100 | 50 | 0 |
| 13 | do. | 20 | DC 50 | 10 | 100 | 50 | 0 |
| 14 | do. | 30 | DC 50 | 8 | 100 | 50 | 0 |
| 15 | do. | 10 | DC 20 | 15 | 100 | 50 | 0 |
| 16 | do. | 10 | DC 80 | 8 | 100 | 50 | 0 |
| 17 | do. | 10 | AC 30 | 14 | 100 | 50 | 0 |
| 18 | do. | 10 | AC 40 | 15 | 100 | 50 | 0 |
| 19 | $(NaPO_3)_n$ | 5 | DC 50 | 11 | 100 | 50 | 0 |
| 20 | do. | 10 | DC 50 | 10 | 100 | 50 | 0 |
| 21 | $Na_2B_4O_7$<br>$K_2CrO_4$ | 2.0<br>6.0 | DC 50 | 10 | 100 | 50 | 0 |
| CE 1 | None | — | — | 15 | 75 | 40 | 2.0 |

Notes:

*1 "DC" is "direct current", "AC" is "alternating current" and "CE" is "comparative example".

*2 Erichsen film test:

On the surface of the coating on the test plate, two sets of eleven notch lines having intervals of 1 mm perpendicular to each other and reaching the surface of the substrate were formed by a knife, thereby 100 of small squares were cut on the coating film. Then, the test plate which was formed with the cross-cut pattern was subjected to Erichsen film tester where the plate was pressed down for 5 mm depth on the backside of the cut surface. The center of the cross-cut pattern and that of the deformation of the plate coincided with each other. Thereafter, a self-adhesive tape of 20 mm in width was applied to the cross-cut pattern and pressed down to adhere tightly to the coating. The self-adhesive tape was then peeled off quickly, and the number of the cut squares remaining on the test plate were counted.

*3 Impact test:

A du Pont impact tester was used, where the impact tip was 2.7 mm in diameter and the weight was 500 g. The estimation was expressed by the maximum height (cm) of the weight at which the coated surface opposite to the struck side was not damaged at all barely.

*4 Salt spray test:

Two straight notch lines which intersected each other and reached the surface of the substrate were cut by using a knife on the coating film of the test plate. The test plate was then sprayed with a 5% sodium chloride aqueous solution using a salt spray tester kept at 35°C for a duration of 500 hours. Thereafter, self-adhesive tape was fixed along a portion of said notches and it was peeled off quickly to observe the defective portion of the coating film. The test result is indicated by the maximum width (mm) of the defective portion of the coating film from the center line of the notch.

EXAMPLES 22 TO 25 AND COMPARATIVE EXAMPLES 2 TO 3

Three sets of test plates, where each set consisted of two aluminum plates (grade: 5052P in Japanese Industrial Standard) of 1.2 mm thickness, were used. Using 10 % aqueous sodium silicate ($2SiO_2.Na_2O$) solution (as in Example 12) for one set and 10 % aqueous sodium polymetaphosphate [$(NaPO_3)_n$] solution (as in Example 20) for another set, electrochemical conversion was carried out in like manner as the foregoing Examples 12 or 20, respectively. The third set of test plates was not subjected to the conversion coating.

Then, every test plate was further finish-coated using electrodeposition coating compositions for clear coat, in which one plate of each set was applied with an epoxy resin coating composition and the other of each set was with a polybutadiene coating composition. The preparation of these electrodeposition coating compositions will be manifested later.

In the electrodeposition coating procedure, each aluminum test plate was made the anode and the bath temperature was maintained at 30°C. The applied electric voltages were 80 volts for the former coating composition and 100 volts for the latter coating composition. The duration of the electrodeposition was 2 minutes in every case.

After the electrodeposition, the aluminum test plates were heated for 20 minutes to cure the coating at 160°C for the former coating composition and at 170°C for the latter coating composition. Then the test plates were subjected to the film tests in like manner as the foregoing Examples, the results of which being shown in the following Table 3.

PREPARATION OF THE EPOXY RESIN COATING COMPOSITION FOR ELECTRODEPOSITION

To a reaction vessel were fed 40 parts by weight of Epikote No. 828 resin (trade name of an epoxy resin made by Shell Chemical Corp.) and 100 parts by weight of linseed oil fatty acid, and esterification was carried out by heating at 230°C until the acid value dropped to 10. Then 20 parts by weight of maleic anhydride was added to the epoxy resin ester thus formed and heated to cause maleinization at 180°C for 4 hours, where the acid value of the reaction product was about 140. The reactions were carried out in a nitrogen atmosphere.

The maleinized epoxy resin ester was made water-soluble by partially neutralizing with diethanolamine, the neutralized product was dispersed in deionized water and finally the pH and the resin solids content of thus obtained dispersion was adjusted to 7.8 and 20 % by weight, respectively.

PREPARATION OF THE POLYBUTADIENE COATING COMPOSITION FOR ELECTRODEPOSITION

To a reaction vessel were fed 100 parts by weight of polybutadiene (number average molecular weight 1200, content of 1, 2-addition structure 89 % and content of trans-1, 4-addition structure 11 %), 60 parts by weight of linseed oil and 32 parts by weight maleic anhydride, and heated to cause reaction at 200°C until the acid value because about 170. Then, 76 parts by weight of propyleneglycol was added to 700 parts by weight of the thus obtained reaction product which had incorporated acid anhydride groups through maleinization and was subjected to half-esterification by heating at 100°C by ring-opening reaction of the acid anhydride groups until the acid number became 95. The malenized polybutadiene-linseed oil thus obtained was made water-soluble by partial neutralization with triethanolamine and was dispersed in deionized water, the dispersion was finally adjusted to pH 7.8 and 20 % by weight in resin solids content to obtain an electrodeposition coating composition.

Table 3

| Example number | Conversion coating Oxyacid salt | Conc. (wt%) | Voltage (V) *5 | Electro-deposition coating composition | Thickness of electro-deposition coating (microns) | *6 Erich-sen test | *7 Impact test | *8 Salt spray test |
|---|---|---|---|---|---|---|---|---|
| Example 22 | $2SiO_2.Na_2O$ | 10 | 50 | Epoxy resin type | 15 | 100 | 50 | 0 |
| Example 23 | $(NaPO_3)_n$ | 10 | 50 | do. | 13 | 100 | 50 | 0 |
| Comparative Example 2 | None | — | — | do. | 21 | 90 | 50 | 2.0 |
| Example 24 | $2SiO_2.Na_2O$ | 10 | 50 | Polybutadiene type | 12 | 100 | 50 | 0 |
| Example 25 | $(NaPO_3)_n$ | 10 | 50 | do. | 12 | 100 | 50 | 0 |
| Comparative Example 3 | None | — | — | do. | 18 | 85 | 50 | 1.5 |

Notes:
*5 All were direct current.
*6 The same as note *2 of Table 2 except that the depth of pressing down was 7 mm.
*7 The same as note *3 of Table 2.
*8 The same as note *4 of Table 2.

EXAMPLES 26 TO 28 AND COMPARATIVE EXAMPLE 4

Four aluminum test plates as used in foregoing Examples 1 to 4 were provided. Three of them were subjected to conversion coating using the same conditions as Examples 4, 6 and 10 and the remaining one was not pre-treated. These test plates were applied with the aqueous coating composition which was a mixture of an acrylic resin and a melamine formaldehyde resin as used in the foregoing Examples 1 to 21 simply by dipping and dried by standing in the air. Then the coating layer on the plates was cured by heating at 200°C for 30 minutes.

The thus coated aluminum test plates were subjected to the same film tests as those in Examples 1 to 21 and Comparative Example 1, the results of which are shown in the following Table 4.

Table 4

| Example Number | Conversion coating Oxyacid salt | Conc. (wt%) | Voltage (V) | Thickness of electro-deposition coating (microns) | Erichsen test | Impact test | Salt spray test |
|---|---|---|---|---|---|---|---|
| Example 26 | $K_2CrO_4$ | 10.0 | DC 50 | 16 | 100 | 40 | 0 |
| Example 27 | $K_2MoO_4$ | 5.0 | DC 50 | 16 | 100 | 50 | 0 |

Table 4-continued

| Example Number | Conversion coating Oxyacid salt | Conc. (wt%) | Voltage (V) | Thickness of electro-deposition coating (microns) | Erichsen test | Impact test | Salt spray test |
|---|---|---|---|---|---|---|---|
| Example 28 | $KBO_2$ | 5.0 | DC 50 | 16 | 100 | 50 | 0 |
| Comparative Example 4 | None | — | — | 16 | 65 | 40 | 2.5 |

What is claimed is:

1. A coating process for aluminum or aluminum alloys comprising applying a firmly adherent, non-porous, and continuous hydrophilic coating thereto by treating an article made of aluminum or aluminum alloy in an aqueous solution having a pH not below 6 of at least one water-soluble oxyacid salt selected from the group consisting of silicate, borate, phosphate, chromate, molybdate, vanadate and permanganate by passing electric current through one surface of said article, and thereafter applying by electrodeposition a water-soluble or water-dispersible finish coating of a polar resin containing at least one member of the group of epoxy rein, melamine-formaldehyde resin, alkyd resin, polyester, acrylic resin, polybutadiene, natural resin and modified fatty oil composition to the resulting article.

2. The coating process of claim 1 wherein the concentration of said water-soluble oxyacid salt in said aqueous solution is 5–45 percent by weight for silicate, 1–2.5 percent by weight for permanganate and 1 percent by weight to saturation for borate, phosphate, chromate, molybdate and vanadate.

3. The coating of claim 1 wherein said hydrophilic coating is deposited by applying a direct current of 5–200 volts or an alternating current of 5–60 volts between said article and a counter electrode.

4. The coating process of claim 1 wherein the concentration of said water-soluble oxyacid salt in said aqueous solution is 5–45 percent by weight for silicate, 1–2.5 percent by weight for permanganate and 1 percent by weight to saturation for borate, phosphate, chromate, molybdate and vanadate.

5. The coating process of claim 1 wherein the concentration of said water-soluble oxyacid salt in said aqueous solution is 10–30 percent by weight for silicate, 1.2–2.0 percent by weight for permanganate and 2–10 percent by weight for borate, phosphate, chromate, molybdate and vanadate.

6. The coating process of claim 1 wherein said hydrophilic coating is deposited by applying a direct current of 30–120 volts or an alternating current of 10–40 volts between said article and a counter electrode.

7. The coating process of claim 1 wherein said silicate is of the formula $M'_2O.xSiO_2$ in which M′ is sodium, potassium or lithium and $x$ is from 1.5 to 4.0, said borate is selected from the group consisting of lithium metaborate, lithium tetraborate, sodium metaborate, sodium tetraborate, sodium pentaborate, sodium perborate, hydrogen peroxide adduct of sodium borate, sodium boroformate, potassium metaborate, potassium tetraborate, ammonium tetraborate, and ammonium biborate, said phosphate is of the formula $(NaPO_3)_n$ wherein $n$ is an integer from 1 to 12, said chromate is a member of the group consisting of lithium chromate, sodium chromate, potassium chromate, ammonium chromate, calcium chromate and strontium chromate, said molybdate is of the formula $xM_2O.yMoO_3.nH_2O$ in which M is sodium, potassium, lithium or ammonium, $x$ is an integer from 1 to 5, $y$ is an integer from 1 to 12, and $n$ is zero or a positive integer, said vanadate is selected from the group consisting of lithium orthovanadate, sodium orthovanadate, lithium metavanadate, sodium metavanadate, potassium metavanadate, ammonium metavanadate, and sodium pyrovanadate, and wherein said permanganate is selected from the group consisting of sodium permanganate, potassium permanganate and ammonium permanganate.

8. The coating process of claim 1 wherein said oxyacid salt is selected from the group consisting of sodium silicate, sodium polymetaphosphate, potassium chromate, potassium molybdate, potassium metavanadate, potassium permanganate, ammonium vanadate, potassium borate, and a mixture of sodium tetraborate and potassium chromate.

* * * * *